US008235033B2

(12) United States Patent
Gallo et al.

(10) Patent No.: US 8,235,033 B2
(45) Date of Patent: Aug. 7, 2012

(54) REMOVABLE FIREPLACE ASSEMBLY

(75) Inventors: Christopher J. Gallo, North Canton, OH (US); David M. Baker, Louisville, OH (US)

(73) Assignee: Heat Surge, LLC, North Canton, OH (US)

( * ) Notice: Subject to any disclaimer, the term of this patent is extended or adjusted under 35 U.S.C. 154(b) by 335 days.

(21) Appl. No.: 12/479,918

(22) Filed: Jun. 8, 2009

(65) Prior Publication Data

US 2010/0307477 A1 Dec. 9, 2010

(51) Int. Cl.
*F24B 1/18* (2006.01)

(52) U.S. Cl. ..... 126/500; 126/544; 29/700

(58) Field of Classification Search ..... 126/500, 126/544, 277; 52/36.3, 27, 127.1; 29/700
See application file for complete search history.

(56) References Cited

U.S. PATENT DOCUMENTS 5,738,084 A * 4/1998 Hussong ..... 126/512
5,887,388 A * 3/1999 Hempel et al. ..... 52/27
6,006,744 A * 12/1999 Taylor ..... 126/543
2005/0133022 A1 * 6/2005 Jones ..... 126/512

* cited by examiner

*Primary Examiner* — Alfred Basichas
(74) *Attorney, Agent, or Firm* — Sand & Sebolt

(57) ABSTRACT

A fireplace assembly comprising a base defining a recess for receiving a fireplace, a fireplace releasably held within the recess, and wherein the base is a functional piece of furniture when the fireplace is removed. A method of removing and replacing a fireplace comprising the steps of providing a first base defining a recess, locating a fireplace within the recess, removing the fireplace from the first base to provide a functional piece of furniture, and locating the fireplace within the recess.

9 Claims, 12 Drawing Sheets

REMOVABLE FIREPLACE ASSEMBLY

BACKGROUND OF THE INVENTION

1. Technical Field

The invention relates generally to an electric fireplace mounted with cabinetry. More particularly, the invention relates to an electric fireplace which is removably secured within a mount having cabinetry. Specifically, the invention relates to a removable electric fireplace which can easily be secured and removed from a number of cabinetry based mounts to provide the appearance of a non-modular unit and the function of a modular unit.

2. Background Information

Fireplaces are a common way of providing heat within the home. However, the installation of a fireplace requires substantial investment in the home as well as planning during construction or significant remodeling. Further, once the fireplace is installed, the look and feel of the room is difficult to change since the fireplace cannot be moved.

In an effort to remedy the concerns of providing heat along with the maneuverability of a portable fireplace, electric fireplaces have been developed. The electric fireplace provides the appearance and heat of a traditional fireplace with the additional benefit of being portable. Since the fireplace is portable, the fireplace can be moved from room to room or repositioned within a room with very little effort.

Fireplaces are also known to be combined with shelving and storage equipment in addition to having the appearance of a traditional brick or wood accented look. In particular, the electric fireplace may include bookshelves on either side, or storage compartments above the fireplace to provide storage capacity proximate the electric fireplace. While the storage capacity is beneficial, the additional material increases the weight of the fireplace assembly and does not provide for adapting the fireplace assembly to the room. Since the fireplace assembly is a single unit, the appearance of the fireplace assembly cannot be changed and must be replaced if a different look or feel is required. Since replacing the fireplace is expensive and a difficult process due to weight of the unit and associated costs, there is a long-felt need for a suitable replacement.

BRIEF SUMMARY OF THE INVENTION

The present invention broadly comprises a fireplace assembly comprising a base defining a recess for receiving a fireplace, a fireplace releasably held within the recess, and wherein the base is a functional piece of furniture when the fireplace is removed.

The present invention also broadly comprises a method of removing and replacing a fireplace comprising the steps of providing a first base defining a recess, locating a fireplace within the recess, removing the fireplace from the first base to provide a functional piece of furniture, and locating the fireplace within the recess.

BRIEF DESCRIPTION OF THE SEVERAL VIEWS OF THE DRAWINGS

A preferred embodiment of the invention, illustrative of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
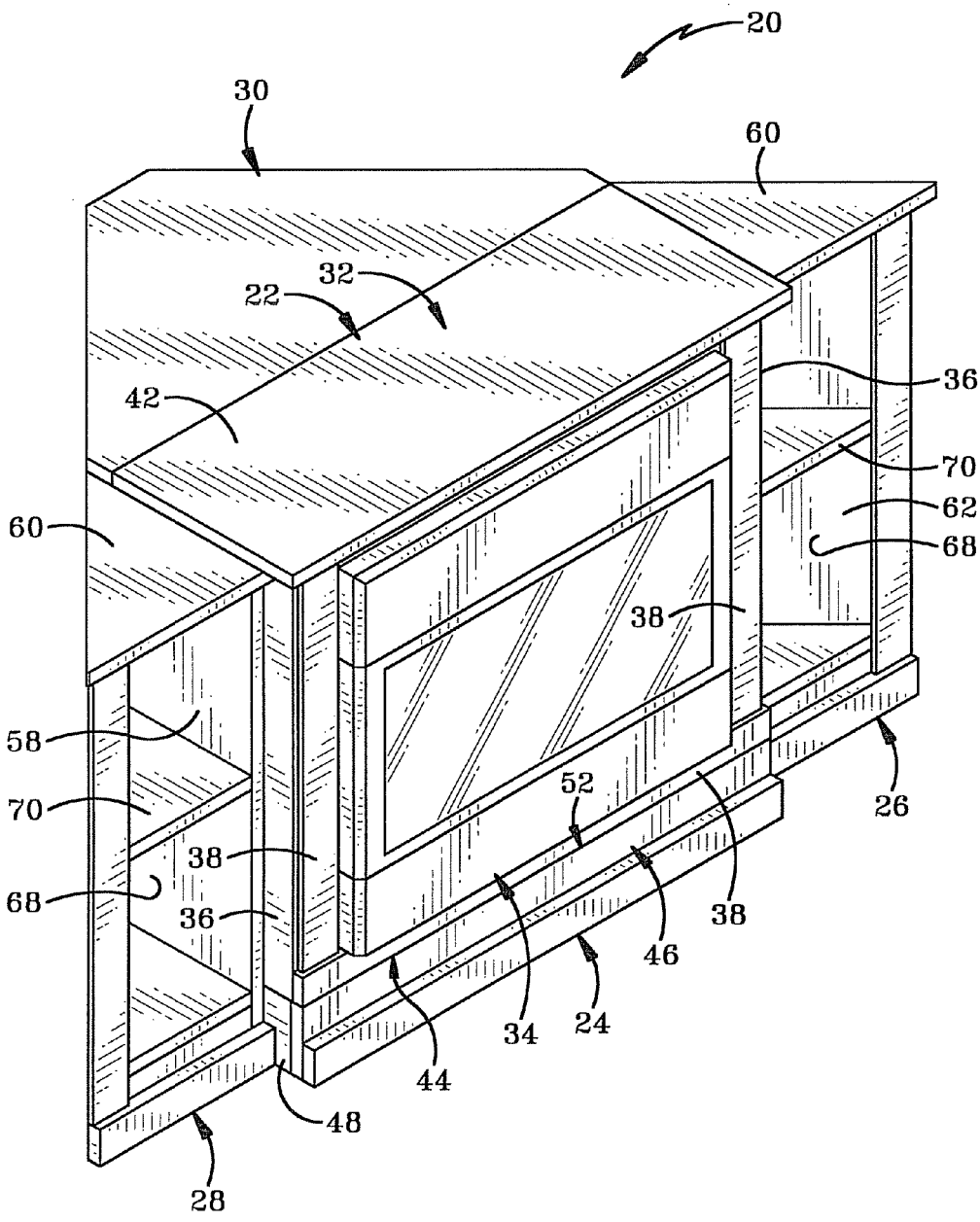
FIG. 1 is a perspective view of a first preferred embodiment of a fireplace located within a base.
Figure 2:
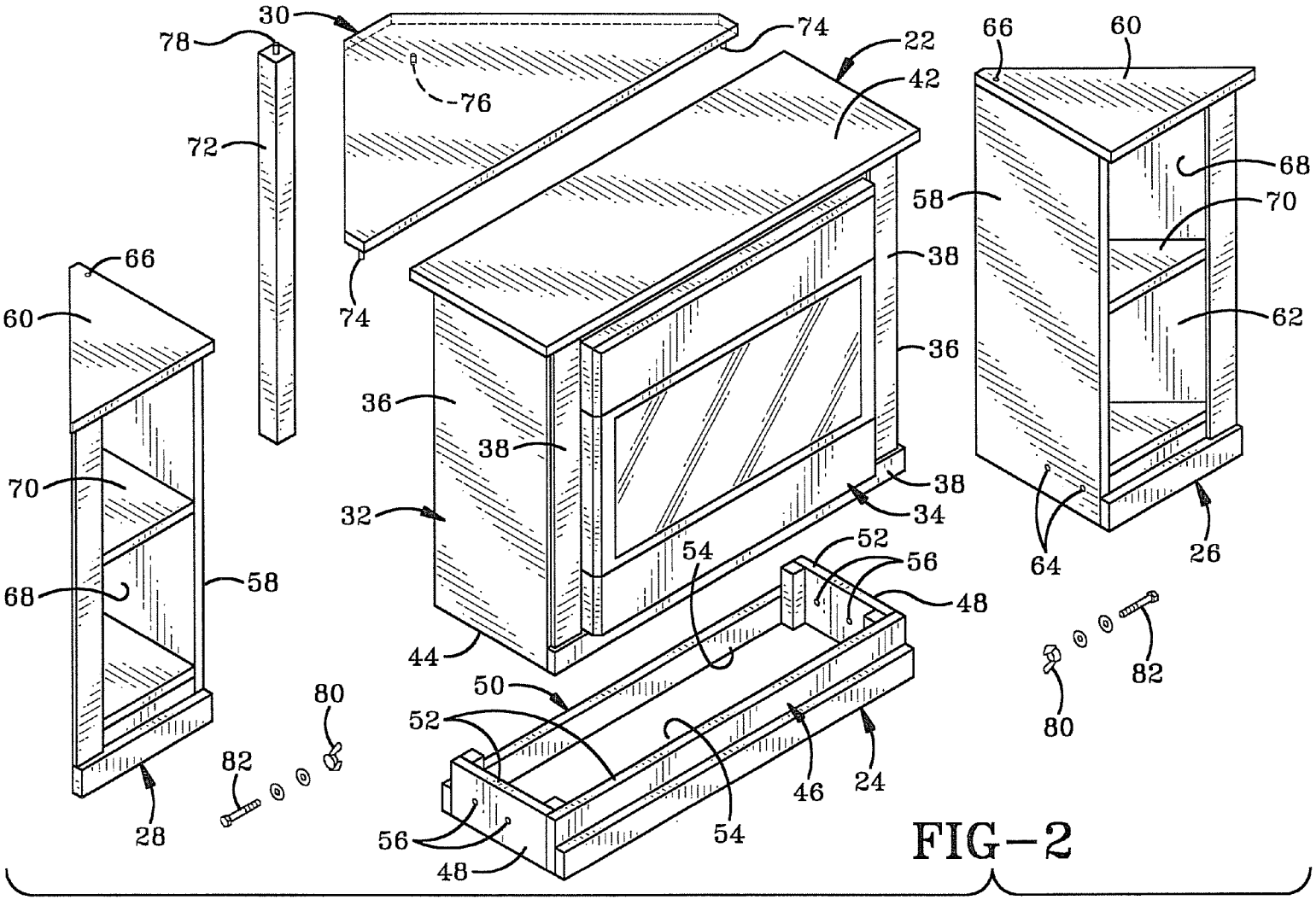
FIG. 2 is an exploded view of the first preferred embodiment fireplace and base.
Figure 3:
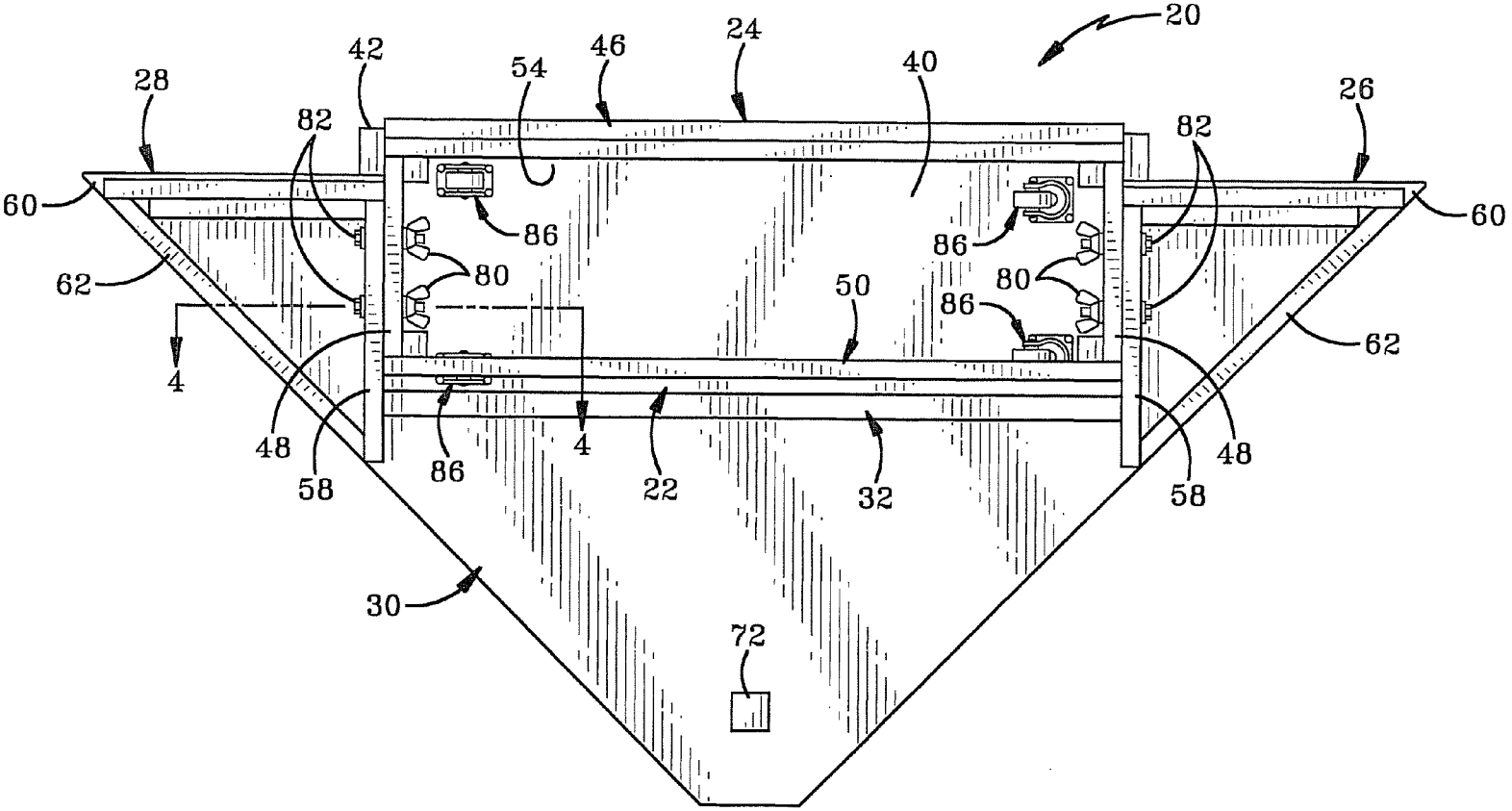
FIG. 3 is a bottom plan view of the first preferred embodiment fireplace assembly.
Figure 4:
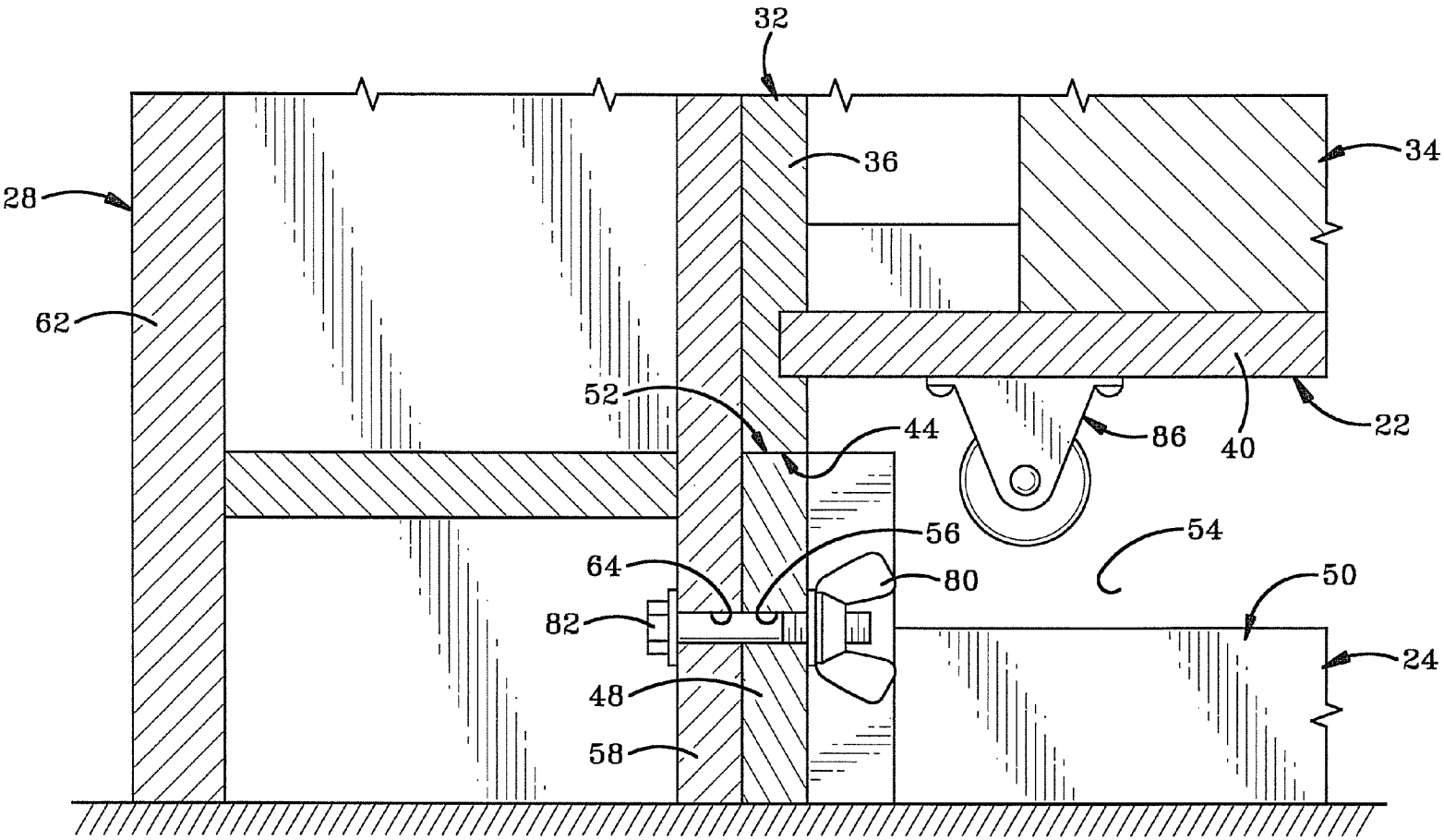
FIG. 4 is a cross-sectional view of the first preferred embodiment fireplace assembly taken along line 4-4 in FIG. 3.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices and materials are now described.

A first embodiment of the fireplace assembly of the present invention is indicated generally at 20, as is particularly shown in FIGS. 1-9. As particularly shown in FIGS. 1 and 2, a first preferred embodiment fireplace assembly includes an electric fireplace 22, a base 24, a first side assembly 26, a second side assembly 28 and a rear upper plate 30. Electric fireplace 22 includes a housing 32 surrounding fireplace 34. Electric fireplace 22 is a traditional fireplace with heated coils and may include a blower motor to expel the heated air from the unit. Housing 34 includes side walls 36, a front wall 38 and a bottom wall 40. Fireplace housing 32 also includes a top wall 42 which extends beyond side walls 36 to form an overhang. Further, side walls 36 and front wall 38 terminate proximate one another and form bottom surface 44 at a lower end of housing 32.

In accordance with one of the main features of the present invention, base 24 includes a front wall 46, a pair of side walls 48 and a rear wall 50. Front wall 46 and side walls 48 are preferably arranged to form a top surface 52 that extends around three sides of the base. Rear wall 50 is preferably shorter than the front wall 46 and side walls 48 to allow the electric fireplace to easily rest on base 24. Further, front wall 46, side walls 48 and rear wall 50 form and define a cavity 54 therein. Each of side walls 48 include holes 56 extending from cavity 54 through their respective side wall. Base 24 is preferably shaped complimentary to fireplace housing 32, and top surface 52 is preferably identical to bottom surface 44 in width and length so that the fireplace housing fits on top of base 24.

First side assembly 26 includes an inner side wall 58, a top wall 60 and an outer side wall 62. Inner side wall 58 and outer side wall 62 are generally arranged to provide a triangular shape, with top wall 60 resting on the upper edges of side walls 58 and 62. At the bottom of inner side wall 58, a pair of holes 64 are formed therein and arranged to be aligned with holes 56 of base 24. Further, top wall 60 includes an aperture 66 for receiving a dowel pin, while inner side wall 58, top wall 60 and outer side wall 62 and form a cavity 68. First side assembly 26 may also include a shelf 70 for separating cavity 68 into several usable sections. Having described the first side assembly, a second side assembly is identical to the first but is merely mirrored to attach to base 24 at the opposite side wall. To that end, second side wall assembly 28 includes the same numbering as first assembly side wall 26.

The first embodiment fireplace assembly also includes a rear upper plate 30 and a prop rod 72. Rear upper plate 30 includes a pair of dowel pins 74 extending from the front periphery of the plate and a hole 76 formed in the back portion of the plates. The rear upper plate is generally triangular in shape and sized such that dowel pins 74 fit within respective aperture 66 of first side assembly 26 and second side assembly 28. Prop rod 72 is preferably the same height as fireplace 22 and first base 24 such that the prop rod maintains the height of rear upper plate 30 at the height of top wall 42 of housing 32. Advantageously, prop rod 72 includes a dowel pin 78 arranged to fit within hole 76. Since rear upper plate 30 has a thickness approximately equal to top wall 42 of housing 32, the rear upper plate and the fireplace top wall create the appearance of a continuous top surface.

Figure 5:
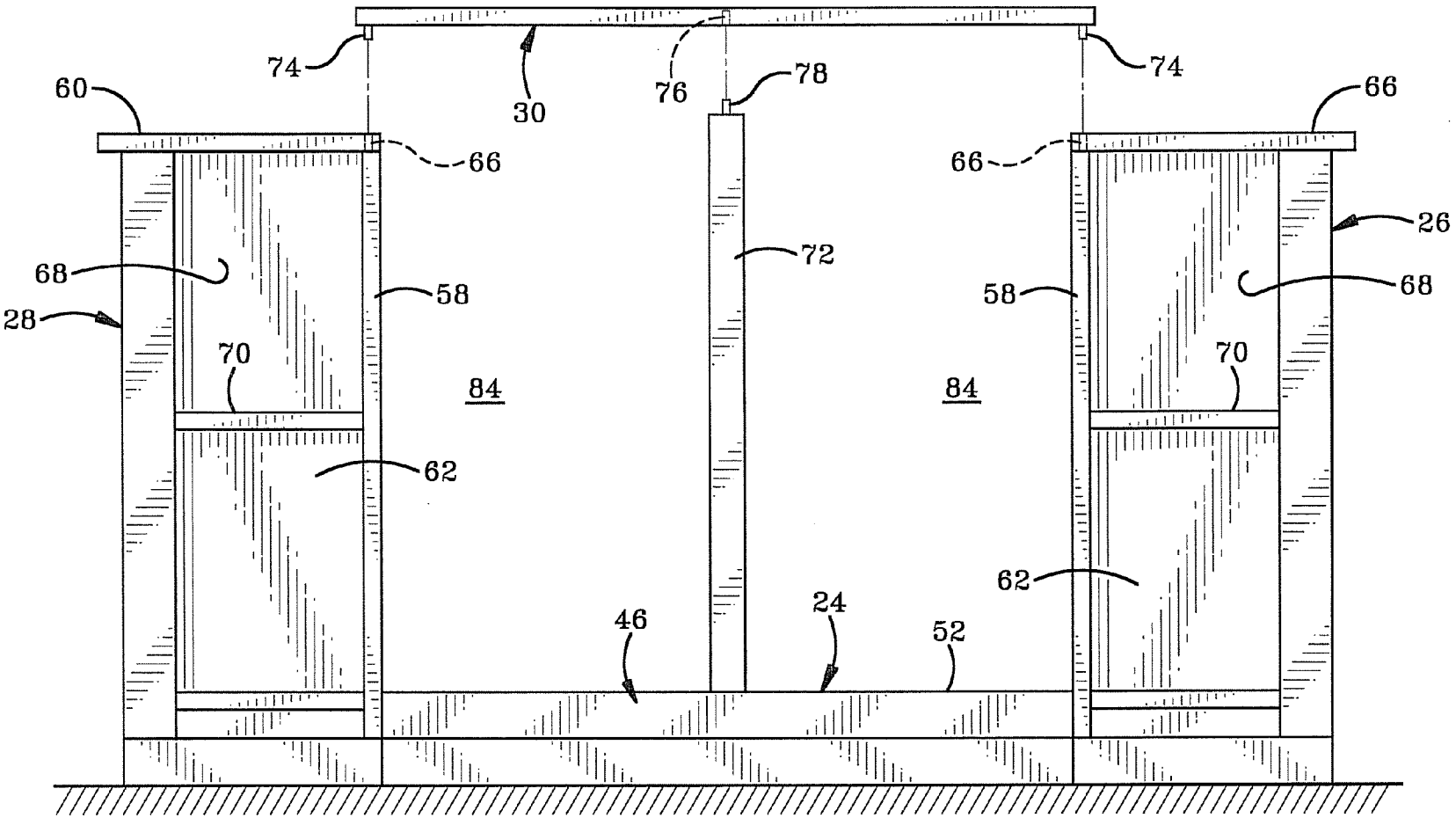
FIG. 5 is a front elevational view of the first preferred embodiment rear upper plates being secured to a pair of side assemblies and a prop rod.
Figure 6:
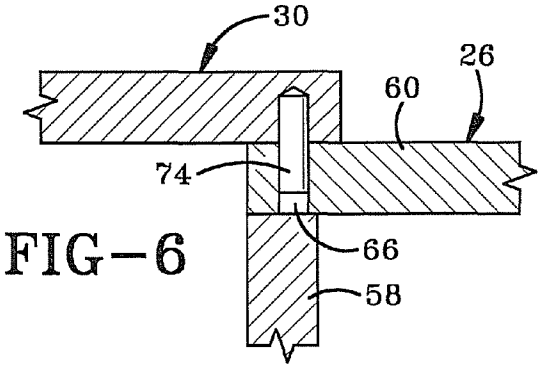
FIG. 6 is an enlarged cross-sectional view of the dowel pin connections of the side assemblies and the rear upper plate.
Figure 8:
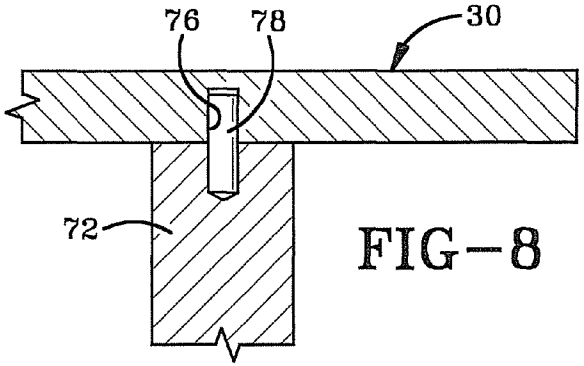
FIG. 8 is an enlarged cross-sectional view of the connection between the prop rod and the rear upper plate.

FIGS. 3-8 illustrate attachments of the various components of the first embodiment fireplace assembly. Initially, side assemblies 26 and 28 are located proximate base 24 and secured to the base with nuts 80 and bolts 82 through holes 56 and 64 respectively. As seen in FIG. 5, once side assemblies 26 and 28 are secured to base 24, a cavity 84 is formed between base 24 and particularly side walls 58 of the first and second side assemblies. Cavity 84 is preferably sized similar to housing 32 in order to removably secure the fireplace housing within the cavity.

Figure 7:
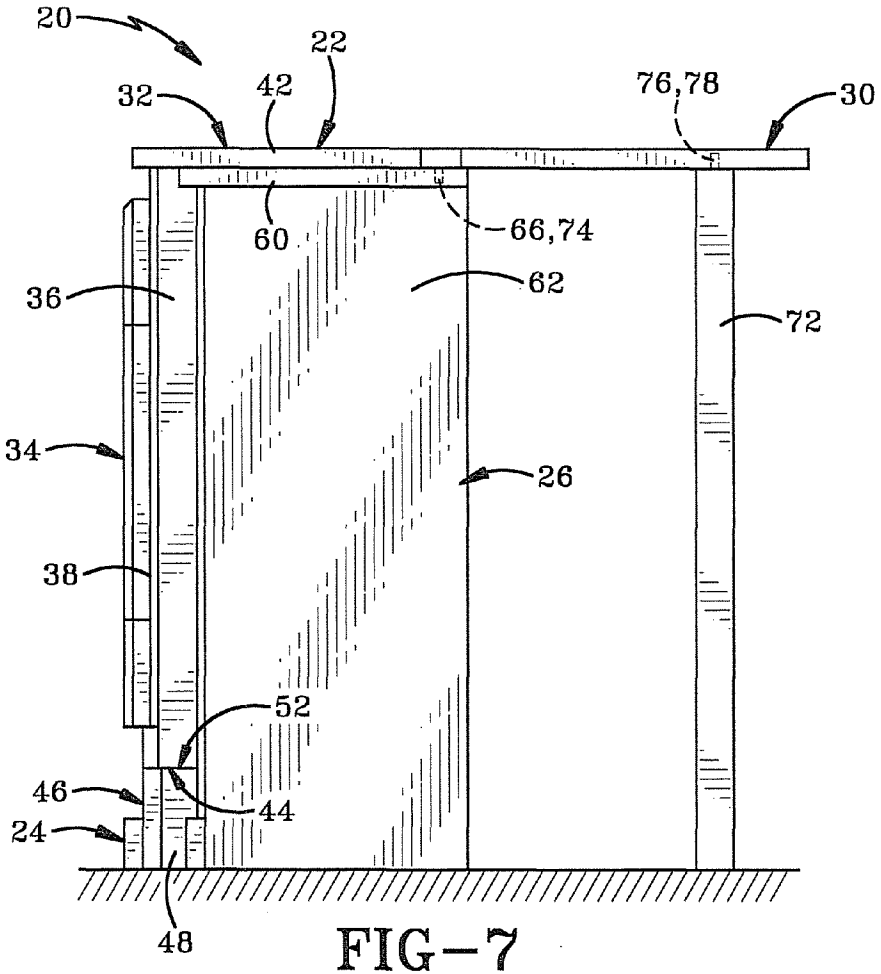
FIG. 7 is a side elevational view of the first preferred embodiment fireplace assembly.
Figure 9:
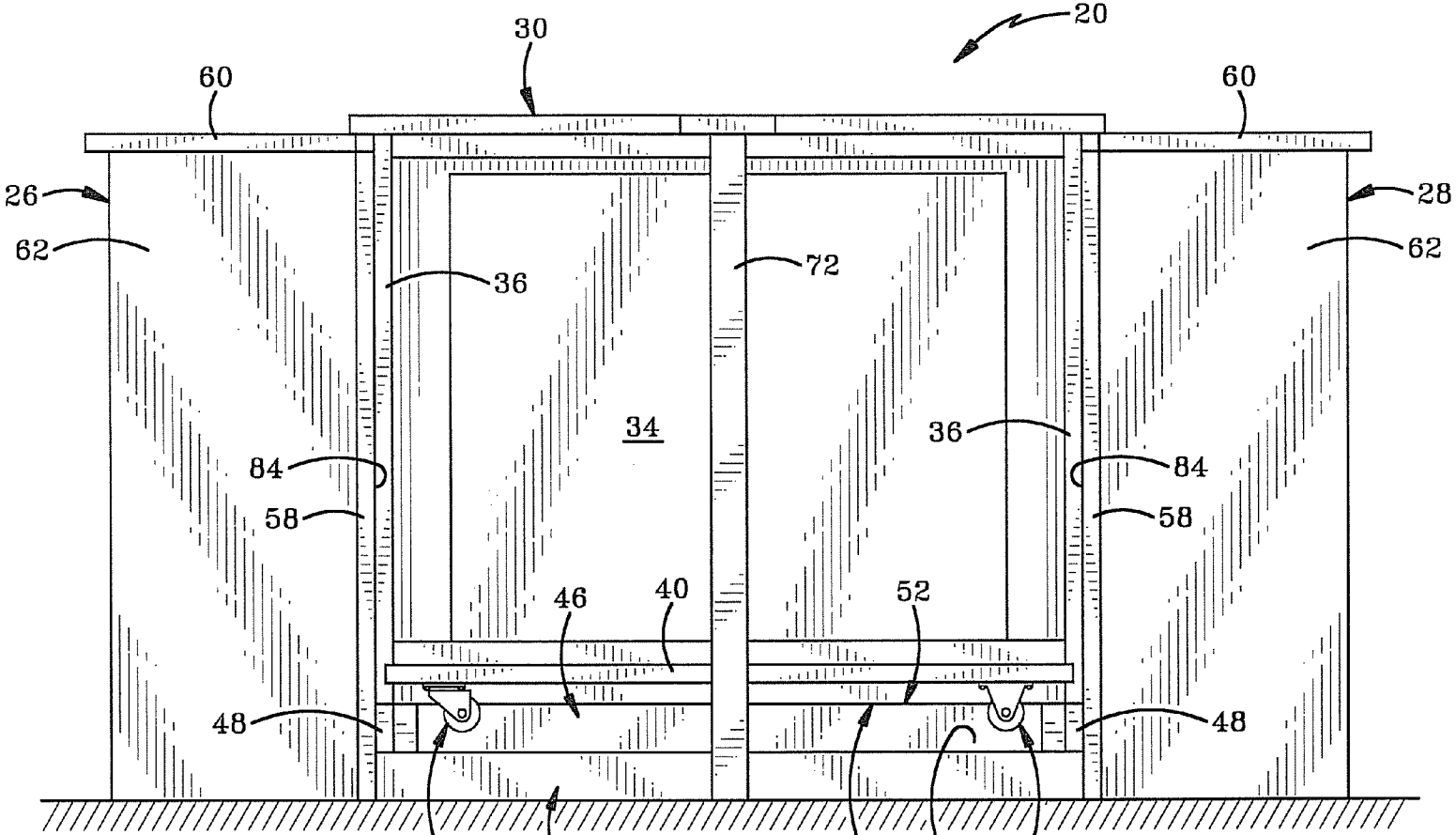
FIG. 9 is a rear elevational view of the first preferred embodiment fireplace assembly.
Figure 10:
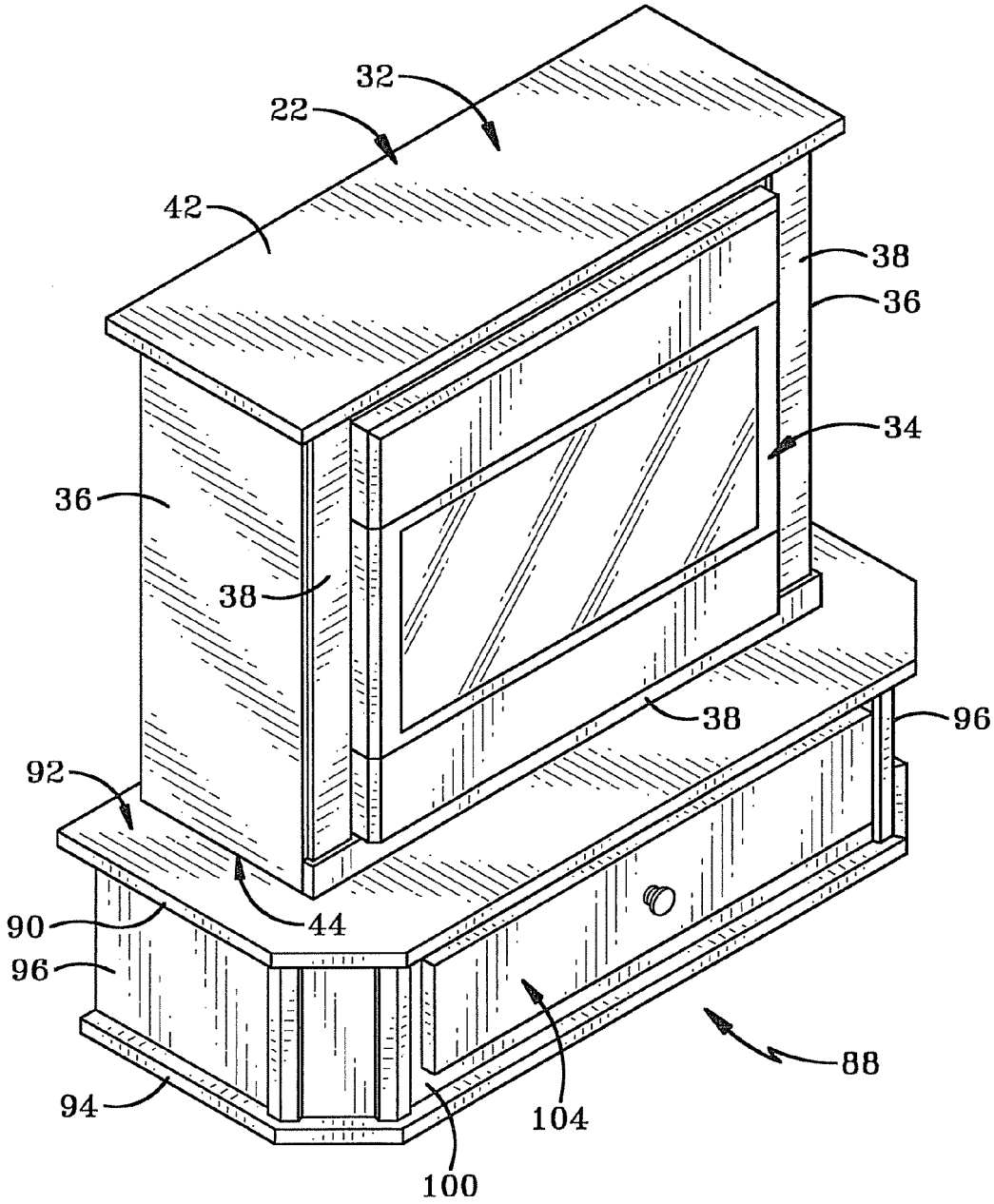
FIG. 10 is a perspective view of a second preferred embodiment fireplace assembly.
Figure 11:
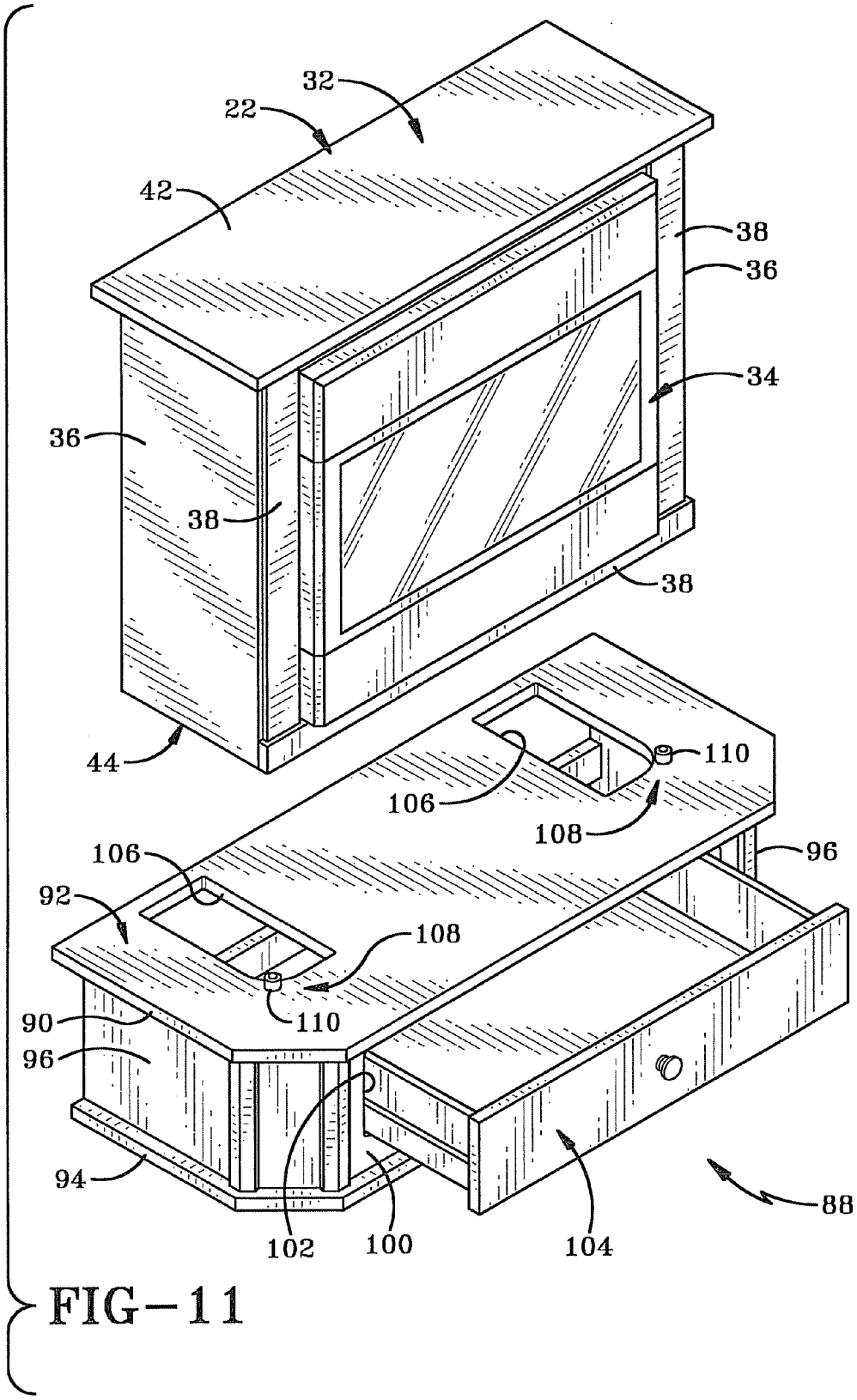
FIG. 11 is an exploded view of the second preferred embodiment fireplace assembly.

FIGS. 5-8 also illustrate the interaction between rear upper plate 30 and side assemblies 26 and 28. After the side assemblies are bolted to base 24, rear upper plate 30 and particularly dowel pins 74 are each located proximate aperture 66, while prop rod 72 and dowel pin 78 are aligned proximate hole 76 in the rear upper plate. Dowel pin 74 and rear upper plate 30 are inserted into aperture 66 of side assemblies 26 and 28. Next, prop rod 72 is located proximate the back of rear upper plate 30 and dowel pin 78 is inserted into hole 76 of the rear upper plate. As seen in FIG. 7, the rear upper plate is flush with top wall 42 of fireplace housing 32 to provide the appearance of a continuous surface.

In accordance with another main feature of the invention, after base 24, side assemblies 26 and 28, and rear upper plate 30 are assembled as a single unit, electric fireplace 22 and fireplace housing 32 can then be inserted within cavity 84. Electric fireplace 22 also includes a plurality of wheels 86 where one set of wheels is preferably a caster style to allow the wheel to swivel while the other set of wheels is preferably fixed direction style wheels. Wheels 86 extend from bottom wall 40 of fireplace housing 32 and are attached between bottom surface 44. The wheels protrude below the bottom surface to permit the wheels to contact the ground and facilitate movement of the fireplace when outside of the fireplace assembly. Accordingly, when electric fireplace 22 is inserted within cavity 84, wheels 86 are located within cavity 54 of base 24 and no longer in contact with the ground. Since the wheels are located within base 24, the electric fireplace is securely mounted within the fireplace assembly and bottom surface 44 of housing 32 rests directly on top surface 52 of the base.

After the electric fireplace is inserted within cavity 84, the fireplace may be enjoyed along with additional storage within cavities 68 and utilize top wall 42, rear upper plate 30, and top walls 60 of side assemblies 26 and 28 as a mantle to support pictures or other objects. When the owner desires to change the look of fireplace assembly 20, the objects are removed. Next, the owner either lifts electric fireplace 22 and fireplace housing 32 upwards and out of cavity 84 or leans the fireplace housing forward and then pulls the fireplace housing out of cavity 84. The owner can then roll the fireplace housing on wheels 86 to another room or a different location. Thus, the fireplace housing 32 can easily be inserted and removed multiple times from cavity 84 in fireplace assembly 20.

Having described the structure and operation of the first embodiment, a second embodiment will now be described in greater detail. Similar numerals refer to similar parts throughout the various embodiments.

Figure 12:
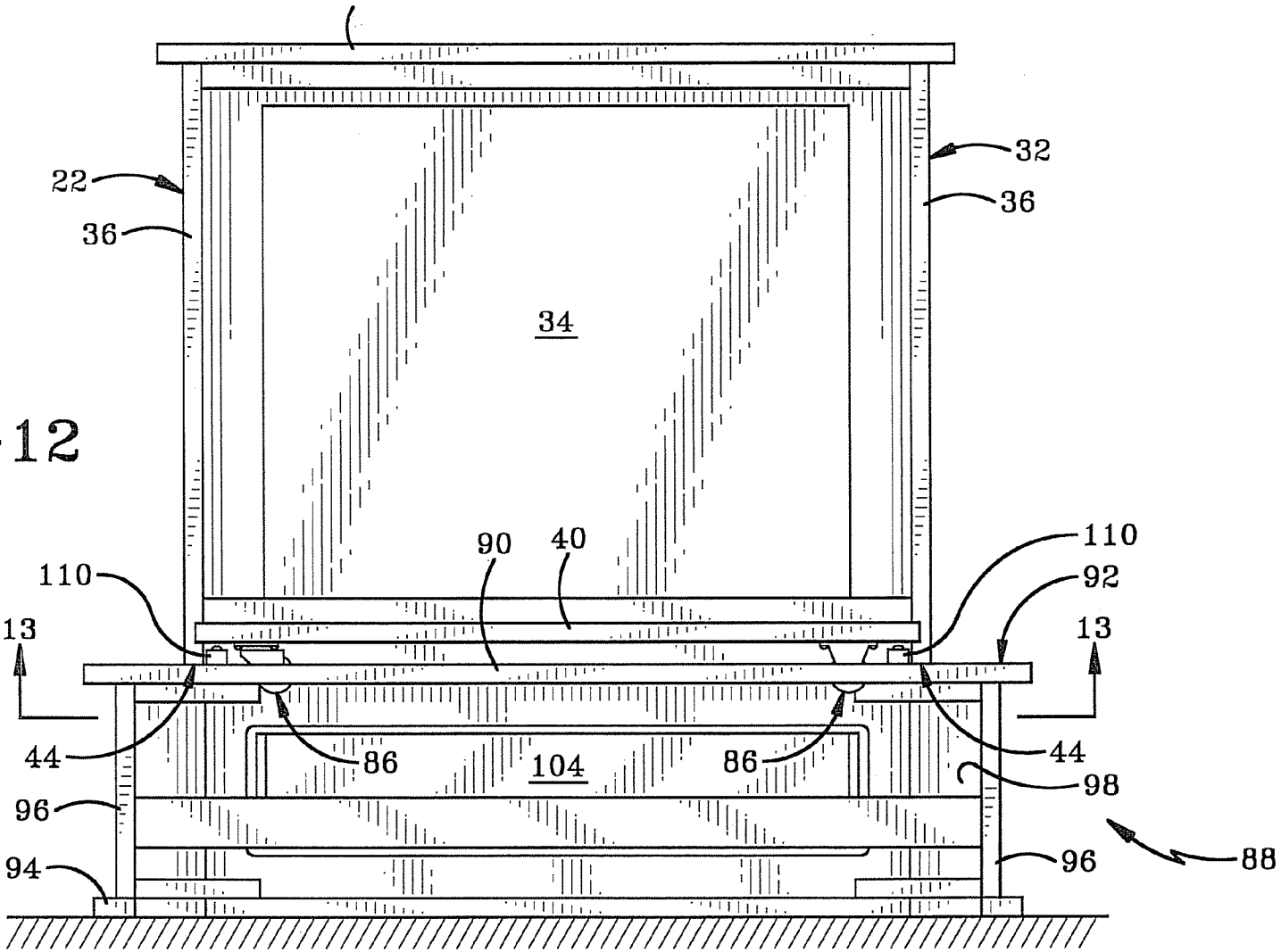
FIG. 12 is a rear elevational view of the second preferred embodiment fireplace assembly.

A second preferred embodiment of the present invention is indicated generally at 88 as is particularly shown in FIGS. 10-14. As specifically shown in FIGS. 10 and 11, the second preferred embodiment fireplace assembly includes a top plate 90 with a top surface 92, a bottom plate 94, and a plurality of side walls 96 arranged perpendicular to both the top plate and bottom plate. Further, side walls 96 separate top plate 92 and bottom plate 94 to form a cavity 98 therein as seen in FIG. 12. Side walls 96 also include a front side wall 100 which includes an opening 102 arranged to receive a cabinet 104 for additional storage below the fireplace.

In accordance with yet another main feature of the invention, top plate 90 includes a pair of apertures 106 extending through top surface 92 and top plate 90. Apertures 106 are shaped and sized to each receive a pair of wheels 86 of fireplace housing 32. An alignment system 108 extends from top surface 92 and includes a pair of tabs 110 proximate apertures 106. Tabs 110 preferably have rounded corners and are generally circular in shape to locate fireplace housing 32 and ensure that wheels 86 extend into aperture 106.

Figure 13:
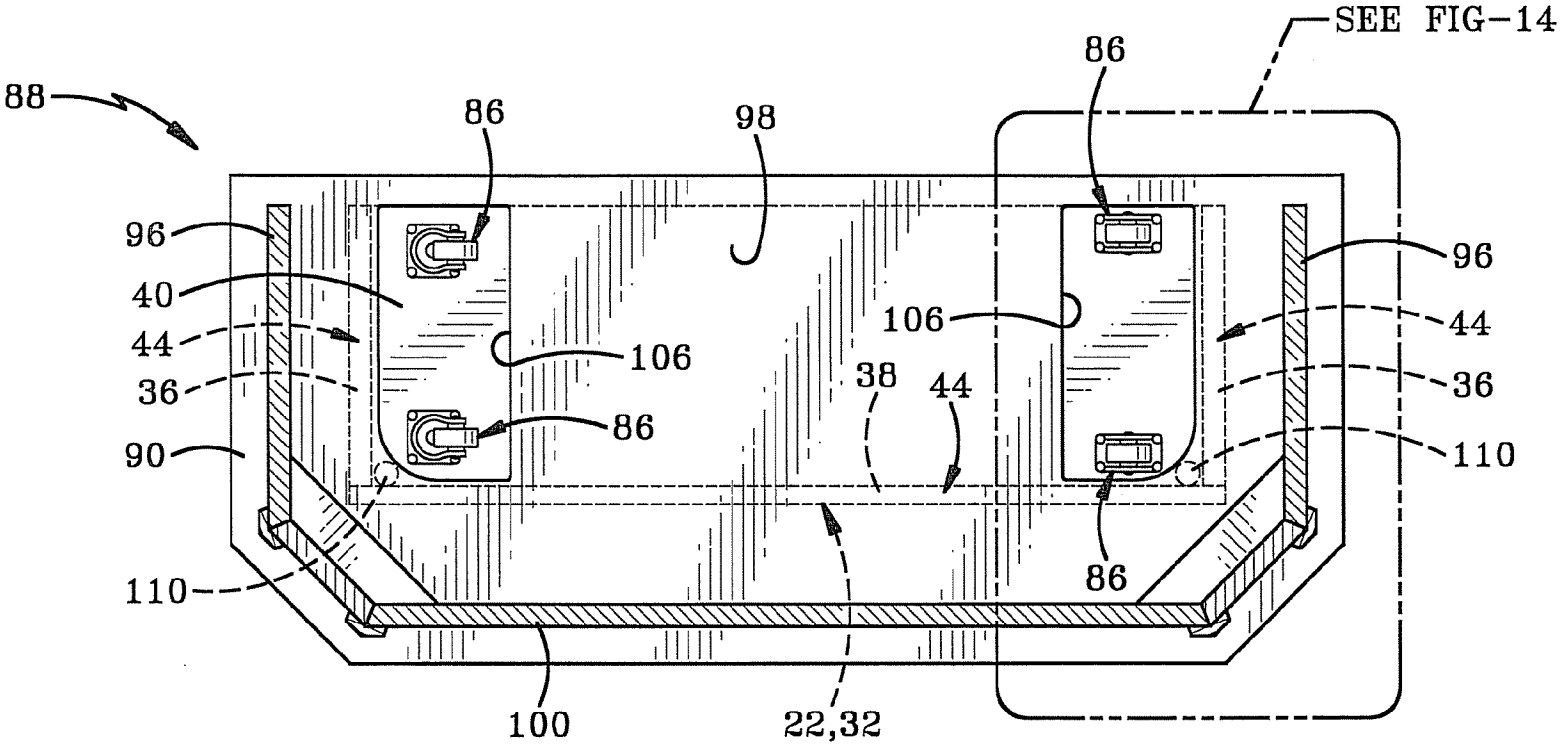
FIG. 13 is a bottom plan view of the second preferred embodiment fireplace assembly taken along lines 13-13 in FIG. 12 with portions shown in section.
Figure 14:
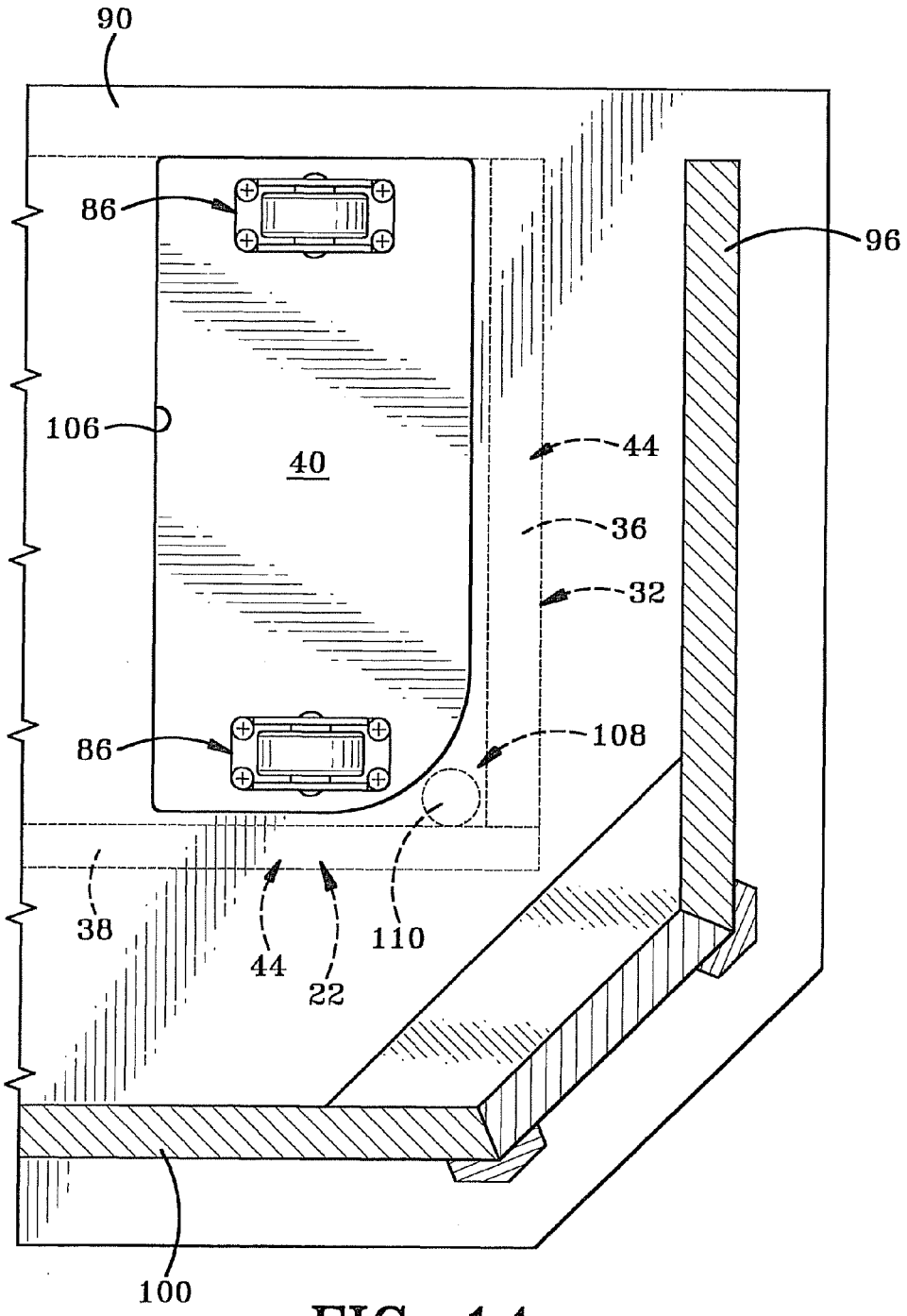
FIG. 14 is an enlarged bottom plan view of the second preferred embodiment fireplace assembly as indicated in FIG. 13 with portions shown in section.

Electric fireplace 22 and housing 32 are located on top surface 92 of top plate 90 and housing front wall 38 is located proximate tabs 110 as seen in FIG. 13. Further, housing side walls 36 are also located proximate tabs 110. Alignment system 108 acts to locate housing 32 so that wheels 86 are disposed within apertures 106. Specifically, housing 32 is pushed backwards or from side-to-side after being set on top surface 92 of top plate 90 so that tabs 110 are each disposed in a corner between respective housing side walls 36 and housing front wall 38. When fireplace housing 32 is located on top surface 92, and tabs 110 are disposed in their proper corners, the housing is perfectly aligned and wheels 86 are located within apertures 106.

When fireplace housing 32 is located atop top plate 90, wheels 86 extend through apertures 106 and into cavity 98. However, due to the height of fireplace housing 32, wheels 86 extend only slightly through apertures 106 and into cavity 98. In particular, wheels 86 extend within cavity 98 a short enough distance to still permit full function of cabinet 104 while disengaging the wheels. When the owner desires to change the fireplace assembly, the owner lifts housing 32 upwards to release the alignment system from the housing as well as remove wheels 86 from cavity 98. Once again, the owner can roll housing 32 to another room or may locate the housing within fireplace assembly 20 or fireplace assembly 88.

Thus, fireplace assemblies 20 and 88 provide an aesthetically pleasing and functional mounts to secure an electrical fireplace while still permitting interchangeability and adaptability within a room. In particular, the fireplace assembly can be adapted with the changing requirements of the room without the additional expense of purchasing a large and cumbersome product. It would be evident to one skilled in the art that a variety of changes can be made that are within the spirit and scope of the present invention. For instance, any particular fireplace assembly mount may be used so long as the electric fireplace is removably secured to the mount and provides the appearance of a single unit.

Accordingly, the electric fireplace assembly is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example and the scope of the invention is not limited to the exact details shown or described.

Having now described the features, discoveries, and principles of the invention, the manner in which the electric fireplace assembly is constructed and used, the characteristics of the construction, and the advantageous new and useful results obtained; the new and useful structures, devices, elements, arrangements, parts, and combinations are set forth in the appended claims.

The invention claimed is:

1. A fireplace assembly comprising:

a base which has a top surface and defines a recess which extends downwardly from the top surface;

a fireplace comprising a housing having a bottom surface and a plurality of wheels which are mounted on the housing and extend at least partially below the bottom surface;

a pair of side assemblies secured to opposite sides of the base and defining therebetween a cavity;

wherein the fireplace has a first position in which the housing rests on the base with the wheels extending downwardly into the recess and a second position in which the fireplace is removed from the base so that the wheels provide rolling movement of the fireplace;

wherein the base remains stationary when the fireplace is removed from the base;

wherein the base is within the cavity;

the cavity extends upwardly above the top surface of the base; and the housing of the fireplace is received within the cavity in the first position and removed from the cavity in the second position.

2. The fireplace assembly of claim 1 wherein the base and the fireplace define a mantel.

3. The fireplace assembly of claim 1 wherein the base top surface surrounds the recess and the housing bottom surface removably rests on the base top surface.

4. The fireplace of claim 3 wherein the base includes a front wall, a rear wall, and a side wall, wherein the rear wall is shorter than the front wall and side wall and the front wall and side wall define the top surface.

5. The fireplace assembly of claim 1 wherein each of the side assemblies includes at least one opening accessible from a front side of each of the side assemblies.

6. The fireplace assembly of claim 1 including a rear upper plate having a pair of dowel pins arranged for engagement with a hole in a top plate of each of the side assemblies.

7. The fireplace assembly of claim 6 including a prop rod having a dowel pin and wherein the rear upper plate includes a hole arranged for receiving the prop rod dowel pin.

8. The fireplace assembly of claim 6 wherein the fireplace includes an upper member and a portion of the upper member rests on each of the side assemblies when the housing of the fireplace is located within the cavity.

9. The fireplace assembly of claim 8 wherein the upper member and the rear upper plate are co-planar and adjacent one another.

* * * * *